US006777603B2

(12) United States Patent
Charbonneaux et al.

(10) Patent No.: US 6,777,603 B2
(45) Date of Patent: Aug. 17, 2004

(54) PERFORATED OPEN VOLUME ACOUSTIC RESONATOR

(75) Inventors: Marc Charbonneaux, Lyons (FR); Patrice Morchain, L'Isle d'Abeau (FR); Pierre Piccaluga, L'Isle d'Abeau (FR); Claude-Annie Perrichon, L'Isle d'Abeau (FR)

(73) Assignee: PICA-Sound International (FR)

( * ) Notice: Subject to any disclaimer, the term of this patent is extended or adjusted under 35 U.S.C. 154(b) by 0 days.

(21) Appl. No.: 10/222,789

(22) Filed: Aug. 19, 2002

(65) Prior Publication Data

US 2003/0029669 A1 Feb. 13, 2003

Related U.S. Application Data

(62) Division of application No. 09/856,148, filed on Sep. 4, 2001, now abandoned.

(51) Int. Cl.[7] ..... G10D 13/08

(52) U.S. Cl. ..... 84/402; 84/403; 84/270; 84/294; 84/189; 84/378; 84/410

(58) Field of Search ..... 181/207, 208, 181/175; 84/402, 403, 270, 294, 189, 378, 410

(56) References Cited

U.S. PATENT DOCUMENTS

| | | | | |
|---|---|---|---|---|
| 872,589 A | 12/1907 | Strauss | ..... | 84/378 |
| 923,689 A | 6/1909 | Newsam | ..... | 84/378 |
| 1,679,290 A | 7/1928 | Bessier | ..... | 84/189 |
| 1,802,791 A | 4/1931 | Sartori | ..... | 84/385 R |
| 3,595,119 A | 7/1971 | Kuijpers | ..... | 84/403 |
| 4,091,703 A | 5/1978 | Adamitis | ..... | 84/378 |
| 4,217,807 A | 8/1980 | Nutting et al. | ..... | 84/402 |
| 5,040,446 A | 8/1991 | Cohen et al. | ..... | 84/418 |

FOREIGN PATENT DOCUMENTS

| | | |
|---|---|---|
| DE | 94 19 828 | 4/1996 |
| FR | 736 779 | 11/1932 |
| FR | 1 473 187 | 6/1967 |

*Primary Examiner*—Shih-Yung Hsieh
(74) *Attorney, Agent, or Firm*—Rothwell, Figg, Ernst and Manbeck

(57) ABSTRACT

The creation of sounds by musical instruments or sound reproduction systems is not perfect, but acoustic dissonances inherent in the production of sound generators can be corrected.

The present method uses open volumes, such as a glass, possibly provided with a cutoff, a fragmentation creating at least one opening. This object placed close to or on a sound generator frees additional sound waves to harmonise with the sound generator by means of mechanical coupling or an air sound link due to the volume of the resonator and its fragmentation.

A device made of a material with a Shore hardness of more than 60 makes it possible via its foot fixed to a piano to transmit mechanical sound vibrations.

Method and device constitute an effective improvement in the reproduction and creation of sounds.

18 Claims, 1 Drawing Sheet

PERFORATED OPEN VOLUME ACOUSTIC RESONATOR

This is a Division of application Ser. No. 09/856,148 filed Sep. 4, 2001 now abandoned. The disclosure of the prior application(s) is hereby incorporated by reference herein in its entirety.

BACKGROUND OF THE INVENTION

The creation of sounds by musical instruments or sound reproduction systems is not perfect, but acoustic dissonances or sound deficiencies inherent in the creation of sound generators can be corrected to provide a full and total sound.

SUMMARY OF THE INVENTION

The present method uses the sound characteristics of an open volume, such as an earthenware vase or a glass possibly provided with at least a cut, creating an opening which can be moved out of centre with respect to the main axis of the object. This object, placed close to or on a sound generator, releases additional sound waves harmonising with the sound generator via mechanical coupling or via the resonance of air waves due to the volume and fragmentation of the resonator fixed at a defined location. The overall sound quality is richer and more precise. By means of the resonance of the volume, a large vase with the opening at its base is able to modify the acoustics of a room.

DETAILED DESCRIPTION

Figure 1:
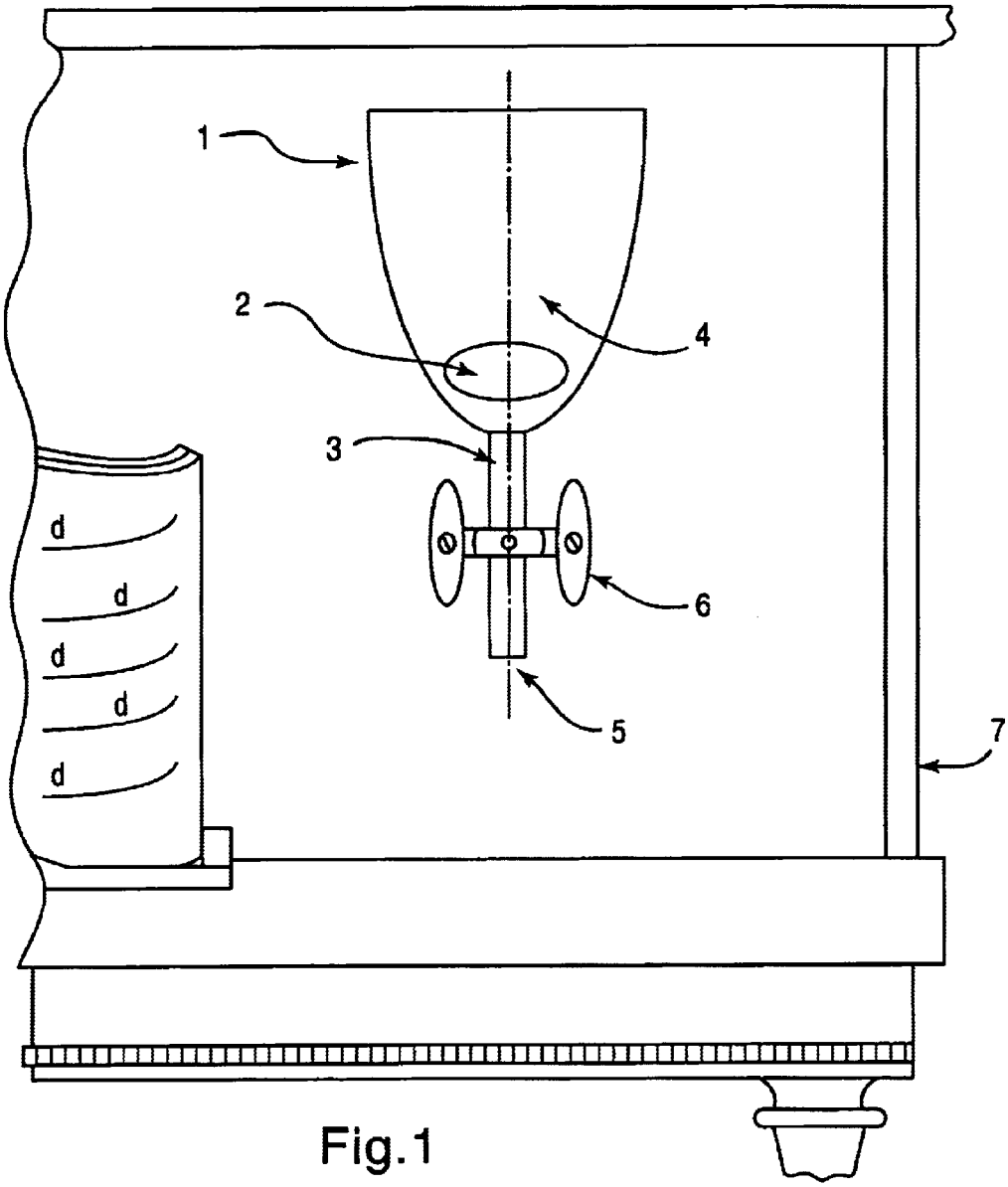
FIG. 1 illustrates an acoustic resonator according to one embodiment of the present invention.
Figure 2:
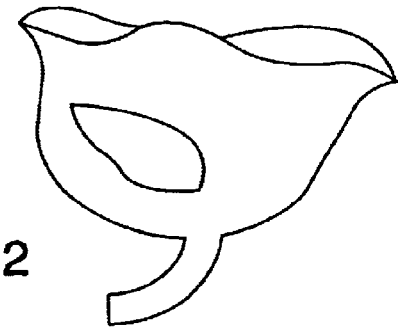
FIG. 2 illustrates an acoustic resonator according to another embodiment of the present invention.

The present method includes a fixed acoustic resonator which improves the sounds created by a sound generator or balances the tonal aspect of a room. The present method is embodied by a quartz device in the form of a glass (1) which is cut (2) close to its base like a watch (FIG. 1). In this non-restrictive embodiment example of the method, the addition of a hollow foot (3) enables air to circulate inside the volume (4) at the end of the foot (5). These sound vibration circulations of air by the resonator are useful, independent of one another, and are thus additional to the sound qualities of the instrument. This foot is able to fix this resonator in a brass support (6) which, secured to a piano (7), transmits the mechanical sound vibrations. The acoustics of the resonators is excellent with rigid materials, such as crystal, glass and metals or alloys like bronze. Ceramic materials are also good. The materials whose hardness is greater than Shore hardness 60 are able to embody the device. The shapes can be homogeneous (FIG. 2), but not symmetrical. The method and device constitute an effective improvement concerning the reproduction or creation of sounds.

What is claimed is:

1. A method for improving the sound emitted by a sound generator, comprising the steps of:

providing an acoustic resonator apparatus comprising a base having a foot and defining an open volume that is closed at one end by the base;

placing the acoustic resonator apparatus on or adjacent to the sound generator;

the acoustic resonator apparatus further comprising at least one cut creating an opening offset from a main axis of said acoustic resonator apparatus.

2. The method of claim 1, wherein said cut is located near the base of the acoustic resonator apparatus.

3. The method of claim 1, wherein the sound generator is a musical instrument.

4. The method of claim 3, wherein the musical instrument is a piano and the acoustic resonator apparatus further comprises a support that is secured to the piano and secured to the foot.

5. The method of claim 1, wherein said foot is hollow.

6. An apparatus, comprising:

a sound generator; and an acoustic resonator means for improving the sound emitted by the sound generator, wherein the acoustic resonator means comprises:

a base;

one or more walls attached to or integral with the base;

a first opening in at least one of said walls; and a second opening in said base, wherein the first opening is located near the base, the one or more walls define an open cavity, and the base of the resonator is mounted on a hollow stem.

7. The apparatus of claim 6, wherein the acoustic resonator means further comprises a support that is secured to the sound generator and secured to the stem.

8. The apparatus of claim 6, wherein the shape of the resonator is not symmetrical.

9. The apparatus of claim 6, wherein the one or more walls comprise a quartz, crystal, glass or ceramic material.

10. The apparatus of claim 6, wherein the one or more walls consist essentially of a metallic material.

11. The apparatus of claim 6, wherein the sound generator is piano.

12. An acoustic resonator for improving the sound of a sound generator, comprising:

a base;

one or more walls attached to or integral with the base, the one or more walls defining an open cavity;

a first opening in at least one of said walls, the first opening being located near the base;

a second opening in said base; and an elongated stem having an end attached to the base and having a hollow core that allows air to flow through the stem and into the cavity.

13. The acoustic resonator of claim 12, wherein the one or more walls are made of a material having a Shore hardness of more than 60.

14. The acoustic resonator of claim 12, wherein the acoustic resonator further comprises a support that is secured to the sound generator and secured to the stem.

15. The acoustic resonator of claim 14, wherein the sound generator is a piano.

16. The acoustic resonator of claim 12, wherein the shape of the resonator is not symmetrical.

17. The acoustic resonator of claim 12, wherein the one or more walls comprise a quartz, crystal, glass or ceramic material.

18. The acoustic resonator of claim 12, wherein the one or more walls consist essentially of a metallic material.

* * * * *

UNITED STATES PATENT AND TRADEMARK OFFICE

CERTIFICATE OF CORRECTION

PATENT NO. : 6,777,603 B2
APPLICATION NO. : 10/222789
DATED : August 17, 2004
INVENTOR(S) : Marc Charboneaux et al.

It is certified that error appears in the above-identified patent and that said Letters Patent is hereby corrected as shown below:

On the Front of the Patent (page 1)

Item (62) should be corrected to read as follows:

-- Division of application Ser. No. 09/856,148, now abandoned, which is the National Stage of International Application No. PCT/FR99/01806, filed on July 22, 1999.--

On the Title Page, Item (30) is included to read

--Foreign Application Priority Data:

November 30, 1998 (FR) 98/15243 -- .

In The Specification

Column 1, cancel the first sentence and replace it with the following sentence:

--This is a Division of application Ser. No. 09/856,148, now abandoned, which is the National Stage of International Application No. PCT/FR99/01806, filed on July 22, 1999.--

Signed and Sealed this

Fifth Day of June, 2007

JON W. DUDAS
*Director of the United States Patent and Trademark Office*